US006375439B1

(12) United States Patent
Missio

(10) Patent No.: US 6,375,439 B1
(45) Date of Patent: Apr. 23, 2002

(54) HERMETIC REFRIGERATION COMPRESSOR WITH IMPROVED CONTROL AND CONNECTION MEANS

(75) Inventor: Roberto Missio, Pordenone (IT)

(73) Assignee: Zanussi Elettromeccanica S.p.A., Pordenone (IT)

( * ) Notice: Subject to any disclaimer, the term of this patent is extended or adjusted under 35 U.S.C. 154(b) by 0 days.

(21) Appl. No.: 09/700,822

(22) PCT Filed: Apr. 20, 1999

(86) PCT No.: PCT/EP99/02642

§ 371 Date: Nov. 20, 2000

§ 102(e) Date: Nov. 20, 2000

(87) PCT Pub. No.: WO99/61847

PCT Pub. Date: Dec. 2, 1999

(30) Foreign Application Priority Data

May 28, 1998 (IT) ..... PN98U0030

(51) Int. Cl.[7] ..... F04B 17/00
(52) U.S. Cl. ..... 417/410.1
(58) Field of Search ..... 417/410.1, 902, 417/423.1, 423.14; 361/22, 23, 32

(56) References Cited

U.S. PATENT DOCUMENTS

| | | | | | |
|---|---|---|---|---|---|
| 3,782,580 | A | * | 1/1974 | Pederson et al. | 220/4.02 |
| 4,467,385 | A | * | 8/1984 | Bandoli et al. | 361/24 |
| 4,571,517 | A | * | 2/1986 | Chastine | 310/68 C |
| 4,748,531 | A | * | 5/1988 | Ortiz | 361/24 |
| 4,846,635 | A | * | 7/1989 | Fry et al. | 417/410 |
| 5,021,915 | A | * | 6/1991 | Wandler et al. | 361/26 |
| 5,515,217 | A | * | 5/1996 | Higashikata et al. | 361/22 |
| 6,150,735 | A | * | 11/2000 | Hisamoto | 307/10.6 |

* cited by examiner

*Primary Examiner*—Teresa Walberg
*Assistant Examiner*—Vinod D Patel
(74) *Attorney, Agent, or Firm*—Pearne & Gordon LLP

(57) ABSTRACT

Hermetic refrigeration compressor, in particular for household refrigeration appliances, comprising control and connection means, such as a motor overload cutout (13) provided with a protective support (14), an electric motor starter (16), a terminal block (17) with related strain-relief (18), and a closing cover (27), in which some of these component parts are integrated into a single one-piece construction (15). The cover (27) is mounted slidably in a direction which is tangential to the casing (10) of the compressor. This solution is advantageous in that it cuts the number of parts to be assembled and reduces the amount of space required to accommodate the compressor.

4 Claims, 2 Drawing Sheets

HERMETIC REFRIGERATION COMPRESSOR WITH IMPROVED CONTROL AND CONNECTION MEANS

BACKGROUND OF THE INVENTION

The present invention refers to a heretic refrigeration compressor, in particular such a compressor as used in refrigeration appliances for household applications.

Hermetic refrigeration compressors of the above mentioned kind are usually enclosed in a container, or casing, on the wall of which there are attached, by means of a mounting bracket welded onto the outside wall of said casing, the control and connection means of the compressor itself. Such means include: an overload cutout device provided with a protective support and electric terminals; an electric starter; a terminal block for the connection of the power supply cables; a strain-relief; and a removable closing cover adapted to enclose and protect all of the above cited means.

An example of such prior-art is described in the European patent publication no 0313024 to the same Applicant.

The prior art calls for a rather complicated and cost-intensive assembly, since the various component parts shall first be preassembled and then attached to the support bracket. Furthermore, the closing cover is attached on to the bracket by snap-fitting it thereonto in the direction of the greater axis of the casing which is oval in its shape. Such a snap-fitting attachment requires a considerable extent of accuracy in the construction of the support in order to ensure a precise, firm and reliable attachment The axial assembly calls for the availability of a greater space inside the refrigeration appliance, since it contributes to a larger overall size of the compressor itself.

In EP-A-0793068 and FR-A-2561831 a hermetic refrigeration compressor is arranged with the protective support, the electrical starter and terminal block integrated into a single one-piece construction. However, the overall assembly is complicated and cumbersome.

BRIEF SUMMARY OF THE INVENTION

It is therefore an aspect of the present invention to simplify and rationalize the construction and the assembly of the component parts constituting the control and connection means of a hermetic refrigeration compressor, so as to do away with the typical drawbacks of the prior-art solutions, while deriving further advantages of both a technical and economic nature.

In particular, the present invention is effective in reducing the number of component parts to be assembled, decreasing the overall space requirements of the compressor, making it easier for the enclosing cover to be attached in position and for access to the control and power connection means of the compressor to be gained.

According to the present invention, the above aims are reached by integrating the teal block housing and the electrical contacts with the addition of the support of the overload cutout of the compressor motor.

BRIEF DESCRIPTION OF THE DRAWINGS

Further features and advantages of the present invention will be more readily understood from the description that is given below by way of non-limiting example with reference to the accompanying drawings.

DETAILED DESCRIPTION OF THE INVENTION

Figure 1:
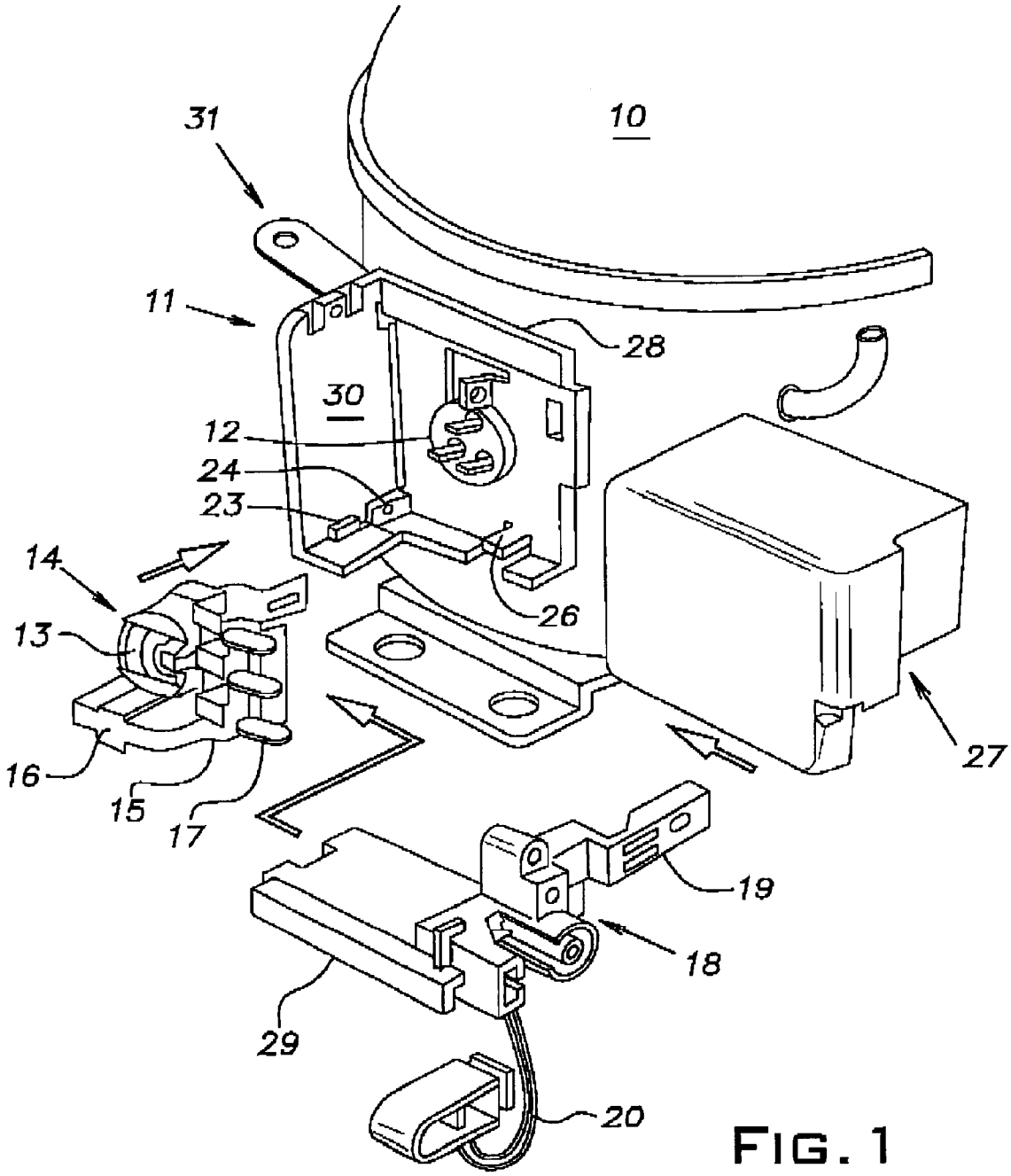
FIG. 1 is an exploded perspective view of a lamination of a hermetic refrigeration compressor with the yet to be assembled control and connection means according to the present invention.

As illustrated in FIG. 1, tie casing of the hermetic refrigeration compressor 10 is provided with an appropriately shaped bracket 11 which is welded on to the outer side surface thereof and from which the part 12 protrudes with the terminals for the connection of the compressor motor to an overload cutout 13. The latter is arranged in a support 14 provided in a one-piece connection is that integrally includes also the electric starter 16 (usually a PTC, ie. a positive temperature coefficient resistor) and the terminal block 17 for the connection of the motor power supply cables.

The power supply cables are fixed by means of a stain-relief device 18 which is provided with elastically pliable appendices 19 and 20 adapted to retain the cables (not shown) in the respective through-passing seats. The stain-relief device 18 is fixed to the bracket 11 through the insertion of appendices 21, 22 (not shown) in respective apertures 23, 24, and the edge 25 (not shown) under the tab 26.

A cover 27 is then inserted onto the bracket 11 so as to enclose all of the above described component parts.

According to the present invention, the first important feature of this improved solution consists in the support 14 of the motor overload cutout 13 and the terminal block 17 having so been made in a single-piece construction 15, thereby eliminating the use of a cable in order to connect said two component parts to each other, as this normally occurs in prior-art solutions. As a result, this is effective not only in enabling the part count to be reduced, but also the assembly of the whole device to be greatly simplified.

Figure 2:
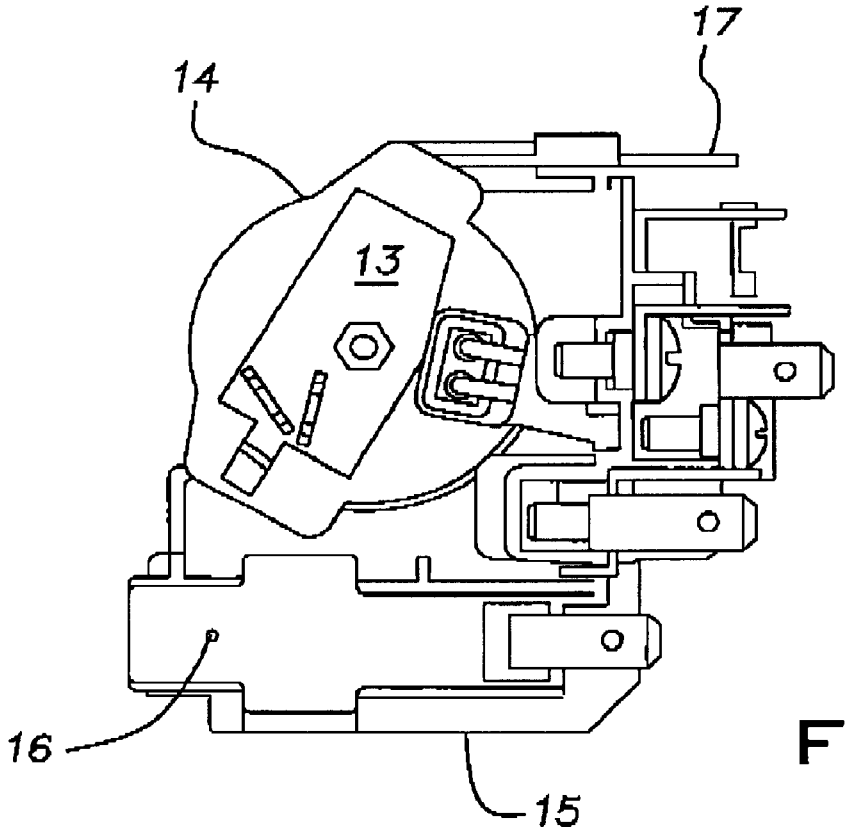
FIG. 2 is a front view of a detail of the control and connection means of the compressor shown in FIG. 1.

The support 14 itself may of course be made so as to enable it to selectively accommodate various types of overload cutouts (FIG. 2).

According to the present invention, the bracket 11 is provided with a first guide 28, and the strain-relief 18 is in turn provided with a second guide 29, said guides being capable of being engaged by corresponding folded edges of the cover 27. These guides 28 and 29 are rectilinear, extend parallel to each other and are arranged horizontally on two distinct levels. Such guides are further substantially orthogonal to the greater axis of the casting 10 of the compressor, which has usually an oval shape. As a result; the cover 27 can be mounted and removed by simply letting it slide on said guides 28 and 29 accordingly.

The present invention ensures a greater assembly accuracy and reliability as compared with the prior art snap-fitting assembly solutions. Furthermore, it enables the space required for accommodating the compressor inside the refrigeration appliance to be reduced. In fact, the assembly/disassembly of the cover is carried out in a direction which is parallel to the smaller axis of the casing 10, ie. from the less-encumbering side of the same casing. The control and connection means of the compressor are made accessible by opening the cover 27 in a direction which is tangential, rather than radial, to the casing 10.

Figure 3:
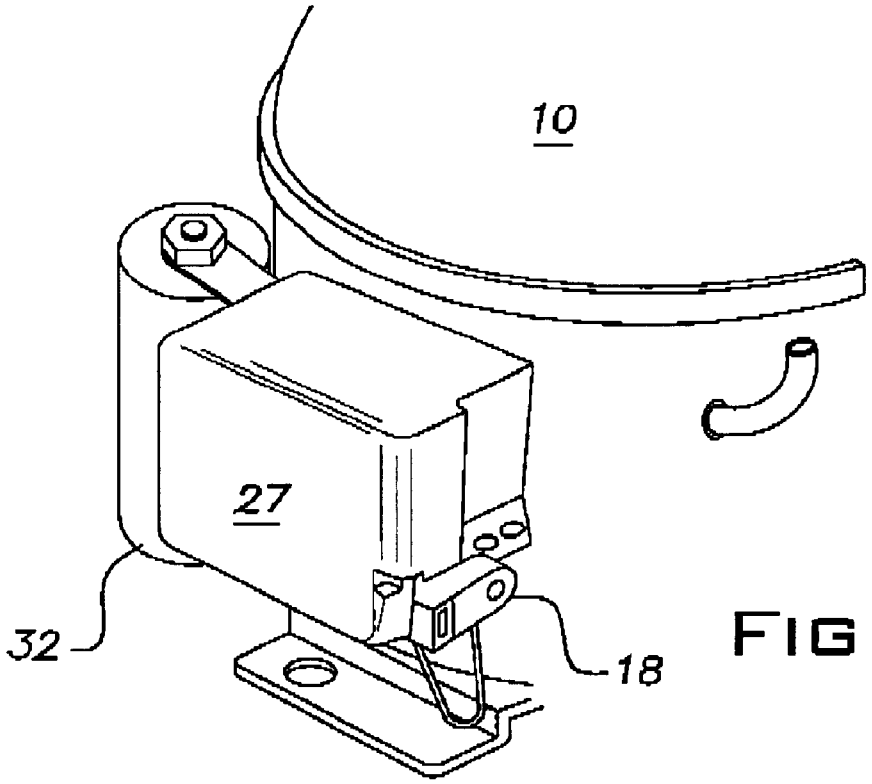
FIG. 3 is a partial perspective view of the compressor show in FIG. 1, but with its control and connection means duly assembled.

According to the present invention the bracket 11 is provided, at the upper end of its portion 30 that is bent orthogonally to the wall of the casing 10, with coupling means for an auxiliary bracket 31. Such an auxiliary bracket 31 is provided, at its free end, with an aperture in which the threaded terminal of a capacitor 32 (FIG. 3) is capable of being inserted to be clamped on the same bracket 31 by means of a corresponding threaded nut. Such a capacitor 32 is the running capacitor of the compressor motor, which quite often, owing to space and encumbrance reasons, is actually arranged separately from the related motor itself and therefore requires a relatively long cable for connection to the terminal block 17, The auxiliary bracket 31 can be made integral or firmly joined with the bracket 11, but is preferably removable in view of making it possible for the capacitor 32 to be arranged in differing manners, according to the actual needs of the user. The proposed solution is anyway effective in bringing about a further integration of the control and connection means of hermetic refrigeration compressors, thereby allowing for a particular effectiveness and convenience in use.

What is claimed is:

1. Hermetic refrigeration compressor, in particular for household refrigeration appliances, enclosed in an outer casing (10) and comprising control and connection means, such as a motor overload cutout (13) provided with a protective support (14), an electric motor starter (16), a terminal block (17) and a strain relief (18) for the connection of the power supply cables, and a closing cover (27), in which al said component parts are mounted on a bracket (11) attached on to the outer wall of the compressor, and said protective support (14), said electric starter (16) and said terminal block (17) are integrated into a single one-piece construction (15), wherein said cover (27) is mounted slidably, in a direction which is tangential to the casing (10), on a first guide (28) provided on the bracket (11) and a second guide (29) provided on the strain-relief (18).

2. Hermetic refrigeration compressor according to claim 1, wherein said guides (28, 29) extend parallel to each other and are arranged horizontally on two distinct levels, in a direction which is orthogonal to the outer axis of the casing (10).

3. Hermetic refrigeration compressor according to claim 1, wherein said bracket (11) supports an auxiliary bracket (31) which the running capacitor (32) of the compressor motor is capable of being fastened to.

4. Hermetic refrigeration compressor according to claim 3, wherein said bracket (11) supports an auxiliary bracket (31) which the running capacitor (32) of the compressor motor is capable of being fastened to.

* * * * *

UNITED STATES PATENT AND TRADEMARK OFFICE

CERTIFICATE OF CORRECTION

PATENT NO. : 6,375,439 B1
DATED : April 23, 2002
INVENTOR(S) : Roberto Missio

It is certified that error appears in the above-identified patent and that said Letters Patent is hereby corrected as shown below:

Column 1,
Line 30, after "attachment", please insert therefor -- . -- (period).
Line 56, please delete "teal", and insert therefor -- terminal --.

Column 2,
Line 11, please delete "tie", and insert therefor -- the --.
Line 17, please delete "is", and insert therefor -- 15 --.
Lines 24 and 25, please delete "stain-relief", and insert therefor -- strain-relief --.
Line 49, please delete "parallel", and insert therefor -- parallelly --.
Line 52, please delete "result;", and insert therefor -- result --.

Column 4,
Line 3, please delete "al", and insert therefor -- all --.
Line 14, please delete "outer", and insert therefor -- greater --.
Line 22, please delete "3", and insert therefor -- 2 --.

Signed and Sealed this

Twenty-fourth Day of September, 2002

*Attest:*

*Attesting Officer*

JAMES E. ROGAN
*Director of the United States Patent and Trademark Office*